US005245943A

United States Patent [19]

Hull et al.

[11] Patent Number: 5,245,943

[45] Date of Patent: Sep. 21, 1993

[54] LAND OR WATER S.O.S. SIGNALING DEVICE

[76] Inventors: Harold L. Hull, 401 Canyon Way #43, Sparks, Nev. 89434; Louisa Lazovich, 12195 Mahogany Dr., Reno, Nev. 89511

[21] Appl. No.: 847,678

[22] Filed: Mar. 2, 1992

[51] Int. Cl.[5] ..... B63C 9/08

[52] U.S. Cl. ..... 116/202; 116/210; 441/89; 441/123

[58] Field of Search ..... 116/202, 209, 210, 211, 116/DIG. 8; 441/17, 20, 30, 66, 89, 123

[56] References Cited

U.S. PATENT DOCUMENTS

| | | | |
|---|---|---|---|
| 309,032 | 12/1884 | Deledochowski | 441/89 |
| 2,629,115 | 2/1953 | Hansen | 116/210 |
| 3,031,693 | 5/1962 | Kirby | 441/30 |
| 3,280,549 | 10/1966 | Hsu | 116/211 |
| 3,425,539 | 2/1969 | Mach | 206/19.5 |
| 3,877,096 | 4/1975 | Scesney | 9/14 |
| 4,044,711 | 8/1977 | Jamison | 116/DIG. 8 |
| 4,094,267 | 6/1978 | Davis, Jr. | 116/124 B |
| 4,230,063 | 10/1980 | Chang | 116/210 |
| 4,281,427 | 8/1981 | Petters | 9/9 |
| 4,433,638 | 2/1984 | Ashline | 116/210 |
| 4,498,879 | 2/1985 | Burr | 441/89 |
| 4,579,536 | 4/1986 | Cameron | 441/20 |
| 4,697,706 | 10/1987 | Schaller | 116/DIG. 8 |
| 4,725,252 | 2/1988 | McNeil | 441/89 |
| 4,731,037 | 3/1988 | Rhodes | 441/41 |
| 4,871,069 | 10/1989 | Guimont | 206/545 |
| 4,901,664 | 2/1990 | Labrecque | 116/210 |

FOREIGN PATENT DOCUMENTS

| | | | |
|---|---|---|---|
| 2444712 | 4/1976 | Fed. Rep. of Germany | 116/209 |

*Primary Examiner*—Thomas B. Will

[57] ABSTRACT

A distress signaling device is disclosed which may be used on land or water which supports a light system spelling out S.O.S. or other indicia which may also become inflated automatically when coming in contact with water and which also may contain a switch which activates the lights automatically when the device is unrolled from it's carrying position. It may also be inflated automatically by a compressed air canister when coming in contact with water or may be blown up manually by mouth and also becomes an emergency air supply. Also the device has a cavity in it's center through which a person's head may be inserted to keep their head above water and becomes an emergency supply of air.

11 Claims, 1 Drawing Sheet

LAND OR WATER S.O.S. SIGNALING DEVICE

FIELD OF THE INVENTION

This invention relates to emergency signaling devices and more particularly to an "S.O.S" lighted signal sign that inflates when activated by a pressure control switch, or can be activated by water contact, or manually.

BACKGROUND OF THE INVENTION

In the past, a number of emergency signaling devices have been taught that deal with balloons, such as U.S. Pat. No. 4,094,267 or the personnel safety marker of U.S. Pat. No. 3,877,096 or rafts which are inflatable such as U.S. Pat. No. 4,731,037 and while these devices are functional for their intended use they do not provide the versatility and convenience of the present invention which may be used on land, water, snow, etc. by individuals who may be lost or injured.

SUMMARY OF THE INVENTION

In view of the limitations of the prior art the present invention provides a unique package which may be carried on the person in a back-pack or the like or may be used on a boat in conjunction with a life-jacket or raft and which is by nature buoyant or may be automatically inflated by a compressed air cartridge, such as a $CO_2$ cartridge or by mouth through a stem, or a pressure activated switch when the device is opened. Included is an automatic water activated switch, a power source such as a battery pack, lights and a construction design that if desired may be placed over the head and worn about the neck to keep the persons head out of the water.

It is therefore a primary object to provide an emergency signal device that may be used by an individual to signal the need for assistance.

Another object is to provide an inflatable signal device that may inflated by mouth or by a compressed air cartridge, and/or automatically by a pressure switch.

It is another object to provide hand grasps for use when used as a floatation device.

Still another object is to provide a sign that when spread out or inflated will read "S.O.S." or "HELP" or other indicia.

Another object is to provide a dye-marker for use in the water, so as to stain the surrounding water for visibility.

Yet another object is to provide indicia on both sides of an inflatable signal device that will be visible no matter which side is up.

Another important object is to provide reflective material to catch and reflect the sun such as mirrors which may also be in the form of small circles or the like and also form the letters "S.O.S." or other indicia.

Yet another object is to provide strings attached to the device so as to be able to tie the device to stakes in the ground as well as to hold the device in a secure manner while in a folded position.

Another object is to provide a signal device which includes a battery pack which cooperates with a switch and multiple lights which may spell out "S.O.S."

Still another object is to provide a hole in substantially the center of the sign corresponding to the "0" in "S.O.S." through which the head of a person may be inserted and held in a secure manner.

Yet another object is to provide a stem close enough to the mouth of a person when the person's head is inserted in the "O" of the "S.O.S." to enable the person to keep the inflated sign full of air and may act as an emergency supply of air during such emergencies as a large wave which may cover the person.

Another object is to make the signal device of air-tight material which is of an eye-catching color such as the international distress color orange.

Yet another object is to make the signal device of a florescent material so as to be visible at night.

An even further object is to provide a switch which not only can be activated or de-activated manually but may be activated by contact with water as water is a conductor.

Still yet another object is to provide a flasher in the circuit to not only Conserve energy but to be more eye-catching.

Other objects and advantages will become obvious when taken into consideration with the following drawings and specifications.

DETAILED DESCRIPTION OF THE DRAWINGS

Figure 1:
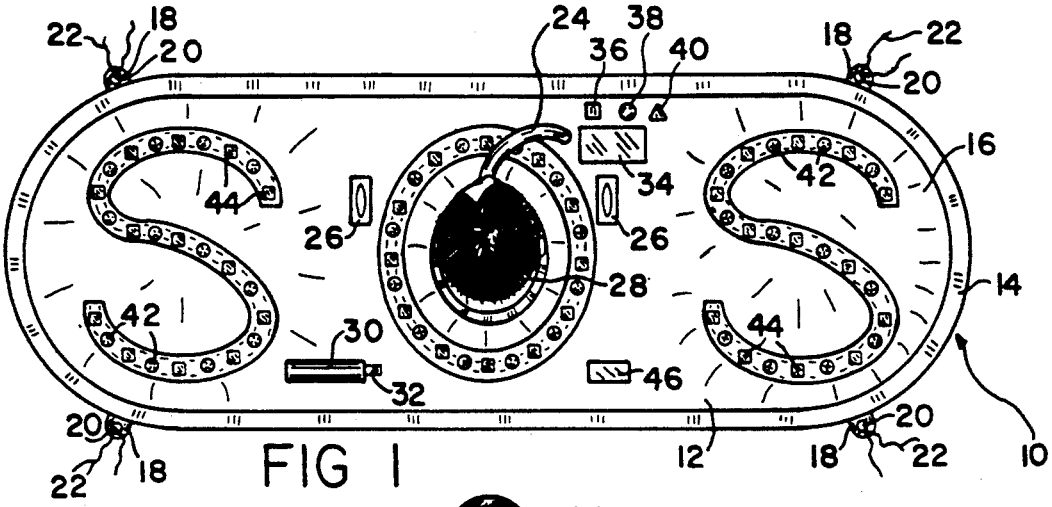
FIG. 1 is a perspective view of the device as it might be used by a person in the water.
Figure 2:
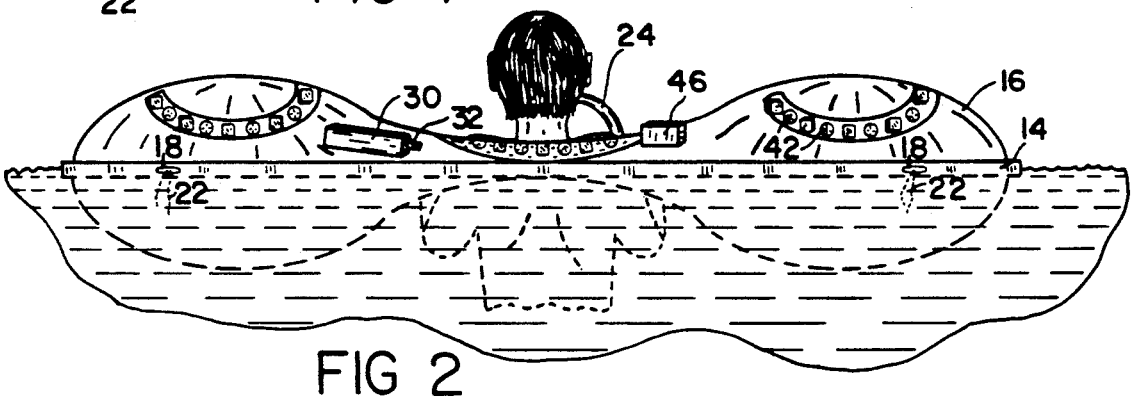
FIG. 2 is a top view of the device as would be seen from overhead.
Figure 3:
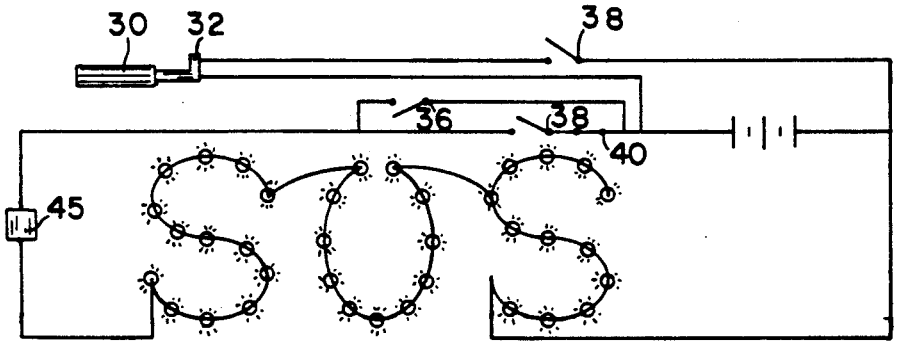
FIG. 3 is a schematic of the electrical circuit of the device.
Figure 4:
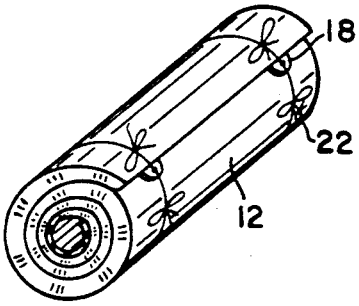
FIG. 4 is a perspective view of the device in a rolled-up first position.

Referring now in detail to the drawings wherein like characters refer to like elements throughout the various views, 10 is an overview of the distress apparatus while 12 is the main body of the sign, made in the form of a bladder from a water resistant, air-tight material that is suitably bonded together at seams 14, thus forming an air-tight cavity 16 (interior) with seam protrusions 18, with holes 20 which may be used for stakes (not shown) or as supports for tie-down strings 22, while 24 is a manual blow-up tube with 26 being hand grasps and 28 being a cavity through which the user may force their head. 30 is a suitable canister such as compressed air or $CO_2$, with 32 being a solenoid operated air valve communicating with canister 30 and cavity 16 and activated by a battery 34 through one of the switches 36, 38, or 40, 36 being a pressure spring loaded switch which is closed when the apparatus is unrolled from it's rolled up carrying position, while 38 are water activated switches normally open but closed when in contact with water, while 40 is a manually operated switch normally closed. 42 are suitable lights with 44 being reflective material such a mirrors which are arranged as are the lights to spell out indicia such as S.O.S. with 46 being a water soluble dye-marker, while 45 is a flasher in the light circuit.

It will now be seen that we have provided a distress signaling apparatus or a S.O.S. signaling device which may be carried in rolled up, uninflated position and which may be used on land or water. If used on the land it may be carried in a backpack or the like and when it is un-rolled a spring loaded switch is released to close a circuit from the battery pack to the lights and if used in the water, the water activated switch also closes the circuit from the battery pack to the solenoid operated canister which inflates the device which now becomes a floatation device. The floatation device may also be used to support the head of a person above water and may be used as an emergency air supply through a mouth tube located close to the mouth of the person which communicates with the interior of the apparatus. Also, the apparatus may be staked to the ground or tied to appropriate natural structures, such as trees, brush, rocks, etc. and the lights may be turned on or off manually to conserve battery power while the reflectors and the lights are so arranged as to spell out S.O.S. or other indicia. Also, we have provided hand holds which may be used to grasp the device when used in water and a water soluble dye-marker to act as a further distress signal.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by Letters Patent is;

1. A distress marker for use on land, water or snow comprising; an inflatable bladder member, said bladder member having a first, second and third position, said first position being in a deflated rolled up position for storage, tie means to retain said bladder member in its said first position, said second position being in an open, substantially flat position to form a distress signal for use on land or snow, said third position forming a floatation and distress signal device for use on water, means to inflate said bladder member, said bladder member having at least a first and second exterior said, at least one of said exterior, sides having indicia spelling out S.O.S., said bladder member supporting a circuit including a battery pack, multiple lights and at least one switch said multiple lights being aligned with said indicia spelling out S.O.S.

2. The distress marker of claim 1 in which said tie means is at least one string and at least one eyelet.

3. The distress marker of claim 1 in which said means to inflate said bladder member is a compressed air canister.

4. The distress marker of claim 3 in which said compressed air canister includes an electrically operated solenoid air valve.

5. The distress marker of claim 1 further including a tube, said tube being capable of being held in the mouth of a person and said tub communicating with the interior of said bladder member.

6. The distress marker of claim 1 in which the "O" in "S.O.S." forms a cavity through which the head of a person may be inserted.

7. The distress marker of claim 1 including multiple reflective members which cooperate with said indicia spelling out "S.O.S.".

8. The distress marker of claim 1 in which said bladder member includes at least one hand hold.

9. The distress marker of claim 1 in which said switch is water activated.

10. The distress marker of claim 1 in which said switch a spring loaded switch in said circuit which is held in an "off" position when said bladder is in said first portion and is in an "on" position when said member is in it's said second or said third position.

11. The distress marker of claim 1 in which said circuit includes a flasher.

* * * * *